US009964892B2

(12) United States Patent
Mizutani

(10) Patent No.: US 9,964,892 B2
(45) Date of Patent: May 8, 2018

(54) IMAGE FORMING APPARATUS

(71) Applicant: KYOCERA Document Solutions Inc., Osaka (JP)

(72) Inventor: Naoki Mizutani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/696,999

(22) Filed: Sep. 6, 2017

(65) Prior Publication Data

US 2018/0074437 A1 Mar. 15, 2018

(30) Foreign Application Priority Data

Sep. 13, 2016 (JP) ..... 2016-178711

(51) Int. Cl.
*G03G 15/08* (2006.01)
*G03G 21/16* (2006.01)

(52) U.S. Cl.
CPC ..... *G03G 15/0875* (2013.01); *G03G 15/0896* (2013.01); *G03G 21/1604* (2013.01); *G03G 2221/1654* (2013.01); *G03G 2221/1657* (2013.01); *G03G 2221/1892* (2013.01)

(58) Field of Classification Search
CPC ..... G03G 15/0822; G03G 15/0824; G03G 15/0832; G03G 15/0839; G03G 15/0865; G03G 15/0875; G03G 15/0877; G03G 15/0896; G03G 21/1642; G03G 21/1647; G03G 21/1676; G03G 2221/16; G03G 2221/1651; G03G 2221/1654; G03G 2221/1657
See application file for complete search history.

(56) References Cited

U.S. PATENT DOCUMENTS

2010/0272452 A1* 10/2010 Tsukijima ..... G03G 15/553 399/27
2010/0303508 A1* 12/2010 Tamura ..... G03G 15/0868 399/258
2016/0054680 A1* 2/2016 Okuda ..... G03G 21/1676 399/258
2017/0102637 A1* 4/2017 Seto ..... G03G 15/0831
2017/0315470 A1* 11/2017 Mochizuki ..... G03G 15/0831
2017/0315501 A1* 11/2017 Mochizuki ..... G03G 15/50

FOREIGN PATENT DOCUMENTS

JP 2005-91462 A 4/2005

* cited by examiner

*Primary Examiner* — Thomas Giampaolo, II
(74) *Attorney, Agent, or Firm* — Stein IP, LLC

(57) ABSTRACT

An image forming apparatus of the present disclosure includes a developing device and a toner storage container. The toner storage container is detachable and attachable with respect to an apparatus main body. The toner storage container includes a supply screw which conveys toner by rotating forward, and a first engagement unit coupled via a gear train to a rotation shaft of the supply screw. The apparatus main body includes a second engagement unit which engages with the first engagement unit to restrain detachment/attachment of the toner storage container by engaging with the first engagement unit. In a case where an amount of toner in the toner storage unit has become equal to or less than a predetermined amount, a control unit makes the supply screw rotate backward to thereby release engagement between the first and second engagement units.

6 Claims, 5 Drawing Sheets

IMAGE FORMING APPARATUS

INCORPORATION BY REFERENCE

This application is based upon and claims the benefit of priority from the corresponding Japanese Patent Application No. 2016-178711 filed on Sep. 13, 2016, the entire contents of which are incorporated herein by reference.

BACKGROUND

The present disclosure relates to image forming apparatuses such as copiers and printers, and, in particular, to image forming apparatuses including a detachable/attachable toner storage container for storing toner to be supplied to a developing device.

Powder developers are mainly used in image forming apparatuses using an electro-photographic method, such as copiers, printers, and facsimile machines, and in a process generally performed in such image forming apparatuses, an electrostatic latent image formed on an image carrier, such as a photosensitive drum, is visualized with toner as a developer stored in a developing device, the toner image is transferred onto a recording medium, and then the toner image is fixed on the recording medium through fixing processing.

In a conventional image forming apparatus, an amount of toner in a toner storage container is detected by using a toner sensor, and when the toner in the toner storage container is used up, a message urging replacement of the toner storage container, for example, is displayed on a display. In response to such a message, the user replaces the toner storage container with a new one.

Here, however, the user sometimes makes a mistake of replacing the toner storage container with a new one even though it is not an appropriate time for the replacement, or removes the toner storage container by mistake.

To prevent such mistakes, a known image forming apparatus is provided with a lock mechanism for locking the toner storage container to the apparatus main body, such that when an appropriate time comes for replacing the toner storage container, the locking is released to allow the toner storage container to be detachable/attachable. Such an image forming apparatus is provided with a solenoid which opens/closes a stopper to switch between locked and unlocked states of the toner storage container.

SUMMARY

An image forming apparatus of a first aspect of the present disclosure includes an apparatus main body, a developing device, a toner storage container, a toner sensor, and a control unit. The developing device is provided in the apparatus main body. The toner storage container stores therein toner to be supplied to the developing device, and is detachable and attachable with respect to the apparatus main body. The toner sensor detects that an amount of toner in the toner storage container has become equal to or less than a predetermined amount. The control unit restrains or allows detachment/attachment of the toner storage container in accordance with a detection result from the toner sensor. The toner storage container is provided with a supply screw which conveys and supplies toner to the developing device by rotating forward, and a first engagement unit which is coupled via a gear train to a rotation shaft of the supply screw. The apparatus main body is provided with a second engagement unit which engages with the first engagement unit to restrain detachment/attachment of the toner storage container. The gear train includes a one-way gear which transmits torque to the first engagement unit only when the supply screw rotates backward. In a case where the amount of toner in the toner storage container has become equal to or less than the predetermined amount, the control unit makes the supply screw rotate backward to thereby release engagement between the first engagement unit and the second engagement unit.

Further features and specific advantages of the present disclosure will become apparent from the following descriptions of preferred embodiments.

DETAILED DESCRIPTION

Hereinafter, an embodiment of the present disclosure will be described with reference to the accompanying drawings.

Figure 1:
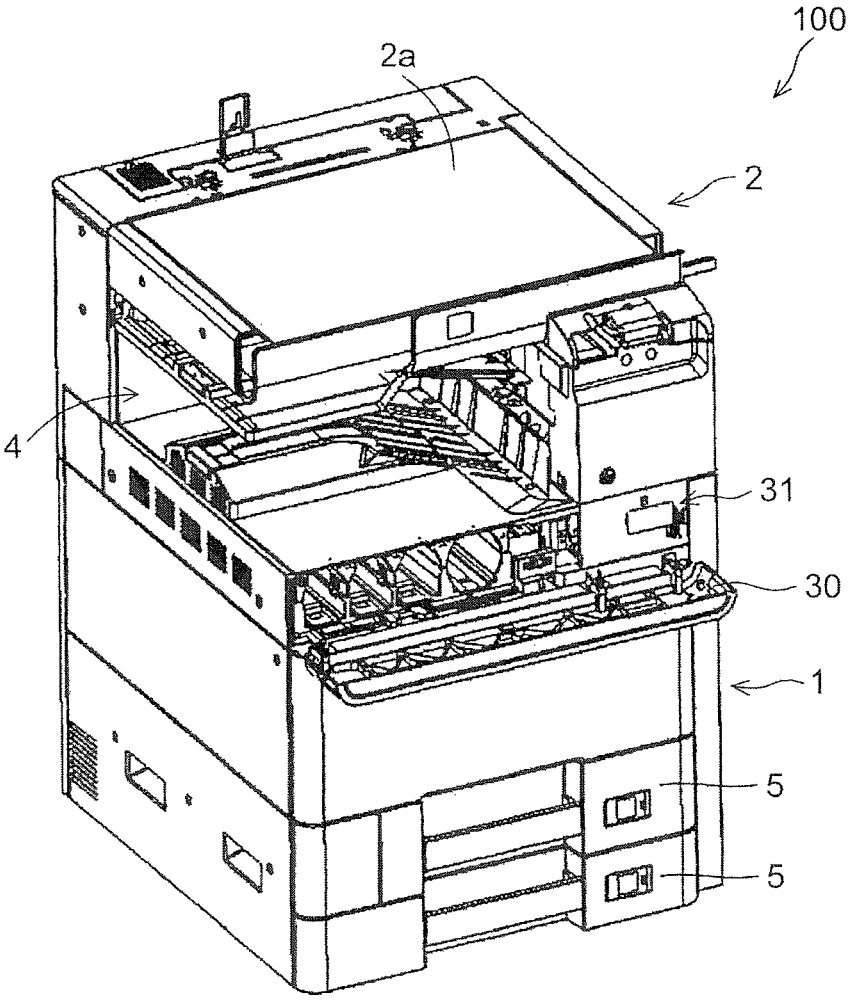
FIG. 1 is a diagram showing a structure of an image forming apparatus according to an embodiment of the present disclosure.

With reference to FIG. 1 to FIG. 7, a description will be given of an image forming apparatus 100 of an embodiment of the present disclosure. As shown in FIG. 1, the image forming apparatus 100 (here, a multifunction peripheral is shown as an example) includes an apparatus main body (image forming apparatus main body) 1 and an image reading unit 2 arranged in an upper part of the apparatus main body 1.

Inside the image reading unit 2, there is provided a reading unit which reads image information from a document placed on a contact glass 2*a*. The reading unit is configured with components such as a scanning optical system which incorporates a scanner lamp, a mirror, and the like, a condenser lens which collects light reflected from the document into an image, and a CCD sensor which converts the light of the formed image into an electric signal (none of which are illustrated), and the reading unit reads a document image and converts it into image data.

In a front part of the image reading unit 2, there is provided an operation panel 50 (see FIG. 7), which has a display, operation keys, and the like. Above the image reading unit 2, a platen (not shown) for holding a document placed on the contact glass 2*a* is provided to be openable and closable.

Between the image reading unit 2 and the apparatus main body 1, there is provided an in-body sheet discharge space 4, which is wide open toward a left side and a front side.

In a front part of the apparatus main body 1, there are provided a plurality of (here, two) sheet cassettes 5 for storing sheets. In an upper part of the front part of the apparatus main body 1, an openable/closable cover 30 is provided to be openable and closable. Opposite to the openable/closable cover 30, inside the apparatus main body, there are provided four container holding portions in which toner containers (toner storage containers) 20*a* to 20*d* (see FIG. 2) are respectively held and an open/close detection sensor 31 configured with an optical sensor, which detects whether the openable/closable cover 30 is opened or closed, and the like. Details of the structure around the toner containers 20*a* to 20*d* will be described later.

Figure 2:
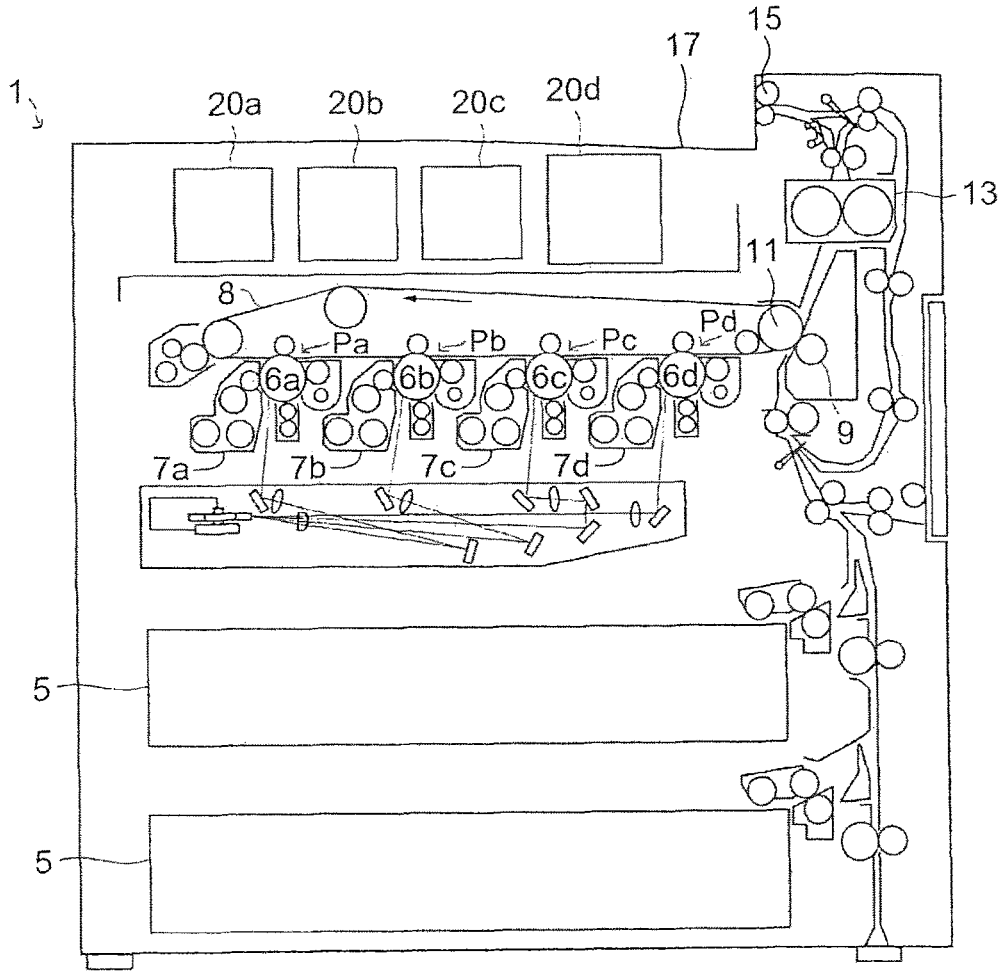
FIG. 2 is a diagram showing the structure of the image forming apparatus according to the embodiment of the present disclosure.

As shown in FIG. 2, in the apparatus main body 1, four image forming units Pa, Pb, Pc, and Pd are arranged in this order from an upstream side (left side in FIG. 1) in a direction in which a later described intermediate transfer belt 8 moves. The image forming units Pa to Pd are provided corresponding to images of four different colors (cyan, magenta, yellow, and black), and sequentially form images of cyan, magenta, yellow, and black through charging, exposure, developing, and transfer processes.

In the image forming units Pa, Pb, Pc, and Pd, there are disposed photosensitive drums (image carriers) 6*a*, 6*b*, 6*c*, and 6*d*, respectively, each for carrying a visible image (toner image) of a corresponding color, and further, the intermediate transfer belt 8, which is caused to rotate by driving means (not shown) in a counterclockwise direction in FIG. 1, is provided adjacent to the image forming units Pa to Pd.

The image forming units Pa, Pb, Pc, and Pd are provided with the rotatably disposed photosensitive drums 6*a*, 6*b*, 6*c*, and 6*d*, respectively, charges which respectively charge the photosensitive drums 6*a*, 6*b*, 6*c*, and 6*d*, an exposure device which irradiates the photosensitive drums 6*a* to 6*d* with light based on image information, developing devices 7*a*, 7*b*, 7*c*, and 7*d* which form a toner image on the photosensitive drums 6*a*, 6*b*, 6*c*, and 6*d*, respectively, and cleaning units which respectively remove developer (toner) and the like remaining on the photosensitive drums 6*a*, 6*b*, 6*c*, and 6*d*.

When image data is received from a host device, such as a personal computer, an electrostatic latent image is formed on each of the photosensitive drums 6*a* to 6*d* in accordance with the image data. The developing devices 7*a* to 7*d* are each filled with a predetermined amount of two-component developer containing cyan, magenta, yellow, or black toner. Here, in a case where the proportion of toner contained in the two-component developer in each of the developing devices 7*a* to 7*d* falls below a specified value after toner image formation, which will be described later, the developing devices 7*a* to 7*d* each receive supply of toner from a corresponding one of the toner containers 20*a* to 20*d*. The toner contained in the developer is supplied onto a corresponding one of the photosensitive drums 6*a* to 6*d* by the developing devices 7*a* to 7*d*, and electrostatically adheres thereto to form a toner image corresponding to the electrostatic latent image formed on the corresponding one of the photosensitive drums 6*a* to 6*d*.

Then, the cyan, magenta, yellow, and black toner images formed on the photosensitive drums 6*a* to 6*d* are primarily transferred onto the intermediate transfer belt 8.

When the intermediate transfer belt 8 starts to rotate in the counterclockwise direction along with rotation of a driving roller 11 caused by a driving motor (not shown), a sheet in the sheet cassette 5 is conveyed at a predetermined timing to a nip portion (a secondary transfer nip portion) between the driving roller 11 and a secondary transfer roller 9 provided adjacent to the driving roller 11, and a full-color image on the intermediate transfer belt 8 is transferred onto the sheet. The sheet onto which the toner image has been transferred receives heat and pressure at a fixing unit 13, and thereby the toner image is fixed on the sheet.

The sheet on which a full-color image has been formed is discharged by a discharge roller pair 15 onto a discharge tray 17, which is provided in the in-body sheet discharge space 4. Note that the image reading unit 2 is not illustrated in FIG. 2.

Next, a description will be given of a detailed structure around the toner container 20*a*. The following description will deal with, as an example, the structure around the toner container 20*a* which supplies toner to the developing device 7*a*, and descriptions of the structures around the toner containers 20*b* to 20*d* which supply toner to the developing devices 7*b* to 7*d* will be omitted, because the structures are basically similar to the structure around the developing device 7*a*.

Figure 3:
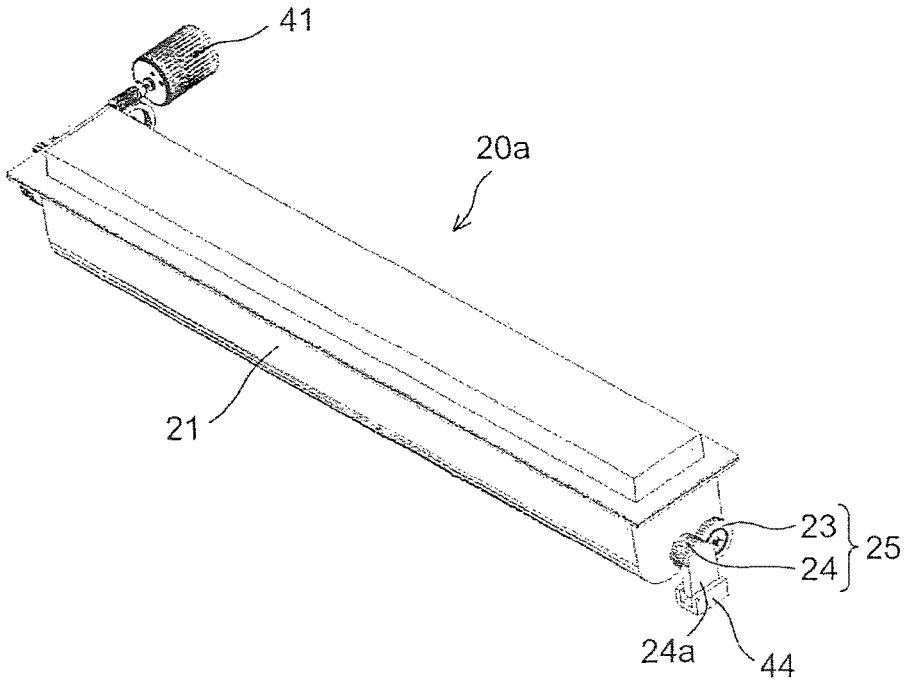
FIG. 3 is a diagram showing a structure around a toner container of the image forming apparatus according to the embodiment of the present disclosure, as seen from a side where a first gear is arranged.
Figure 4:
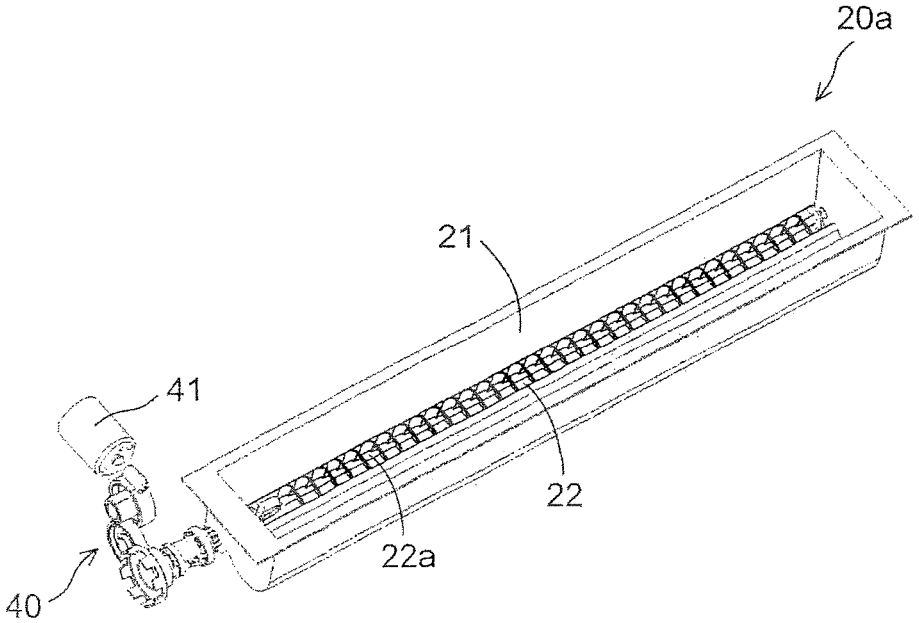
FIG. 4 is a diagram showing the structure around the toner container of the image forming apparatus according to the embodiment of the present disclosure, as seen from a side where a supply motor is arranged.

As shown in FIG. 3 and FIG. 4, the toner container 20*a* includes a container main body 21 which stores toner to be supplied to the developing device 7*a*, and a supply screw 22 rotatably provided in the container main body 21.

The supply screw 22 rotates forward to thereby convey toner stored in the container main body 21 in an axial direction to supply the toner to the developing device 7*a* via an opening (not shown) of the container main body 21. One end part (an end part on the left side in FIG. 4, an end part on a downstream side in a container insertion direction) of a rotation shaft 22*a* of the supply screw 22 is connected to a supply motor 41 via a first gear train 40, which is composed of a plurality of gears, and forward and backward rotations of the supply motor 41 cause the supply screw 22 to rotate forward and backward.

Figure 5:
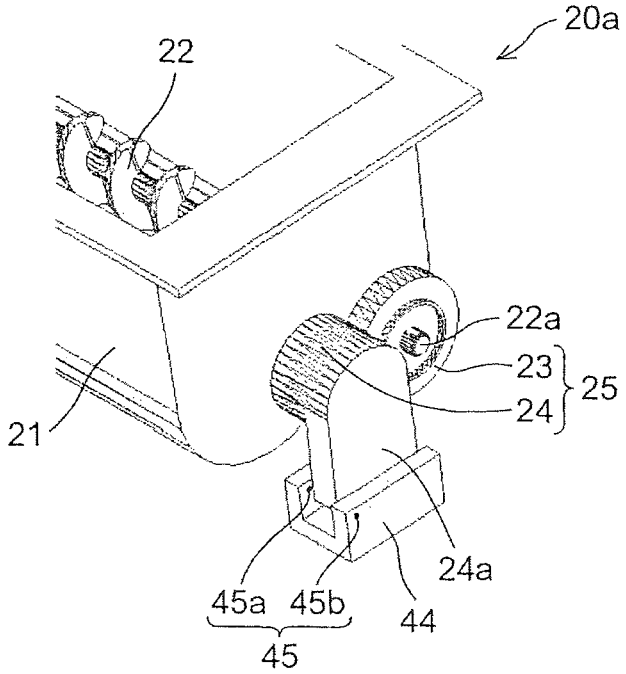
FIG. 5 is a diagram showing a structure around the first gear of the toner container of the image forming apparatus according to the embodiment of the present disclosure, illustrating a state in which an engagement lever is positioned in an engagement position.
Figure 6:
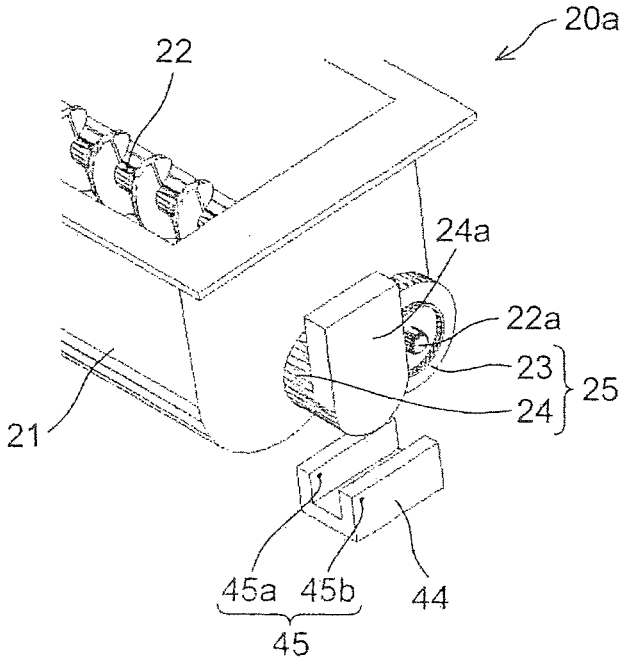
FIG. 6 is a diagram showing the structure around the first gear of the toner container of the image forming apparatus according to the embodiment of the present disclosure, illustrating a state in which the engagement lever is positioned in an disengagement position.

As shown in FIG. 3 and FIG. 5, a first gear 23 is fitted to the other end part (an end part on the right side in FIG. 3, an end part on an upstream side in the container insertion direction) of the rotation shaft 22*a* of the supply screw 22. The first gear 23 meshes with a second gear 24, which is rotatably provided on an end face (side face) of the container main body 21. The first gear 23 and the second gear 24 constitute a second gear train (gear train) 25.

The first gear 23 is a one-way gear which transmits torque only in one direction (a backward rotation direction). As a result, in a case where the supply screw 22 rotates forward, the first gear 23 does not rotate, and thus the second gear 24 does not rotate, either. On the other hand, in a case where the supply screw 22 rotates backward, the first gear 23 rotates, and thus the second gear 24 rotates, too.

The second gear 24, which is arranged on the most downstream side in a torque transmission direction in the second gear train 25, is provided with an engagement lever (first engagement unit) 24*a*, which is formed integral with the second gear 24. The apparatus main body 1 is provided with an engagement member (second engagement unit) 44 having an engagement groove engageable with the engagement lever 24*a*. The engagement lever 24*a* is selectively positioned in an engagement position (the position in FIG. 5) where it engages with the engagement member 44 or in a disengagement position (the position in FIG. 6) where it does not engage with the engagement member 44.

The engagement member 44 engages with the engagement lever 24*a* by the engagement lever 24*a* being positioned in the engagement position, and thereby restrains the detachment/attachment the toner container 20*a*. On the other hand, the engagement member 44 releases the engagement with the engagement lever 24*a* by the engagement lever 24*a* being positioned in the disengagement position, and thereby allows the detachment/attachment of the toner container 20*a*.

The engagement member 44 is provided with a position detection sensor 45 which detects a position of the engagement lever 24*a*. The position detection sensor 45 is a PI sensor which includes a light emitter 45*a* and a light receiver 45*b* which receives light emitted from the light emitter 45*a*. The light emitter 45*a* and the light receiver 45*b* are disposed opposite to each other with the engagement groove of the engagement member 44 interposed therebetween. The position detection sensor 45 detects presence/absence of the engagement lever 24*a* by the engagement lever 24*a* blocking, or releasing the blocking of, an optical path, and feeds a detection result to a control unit 90, which will be described later. The position detection sensor 45 may instead be provided at a position other than in the engagement member 44.

Figure 7:
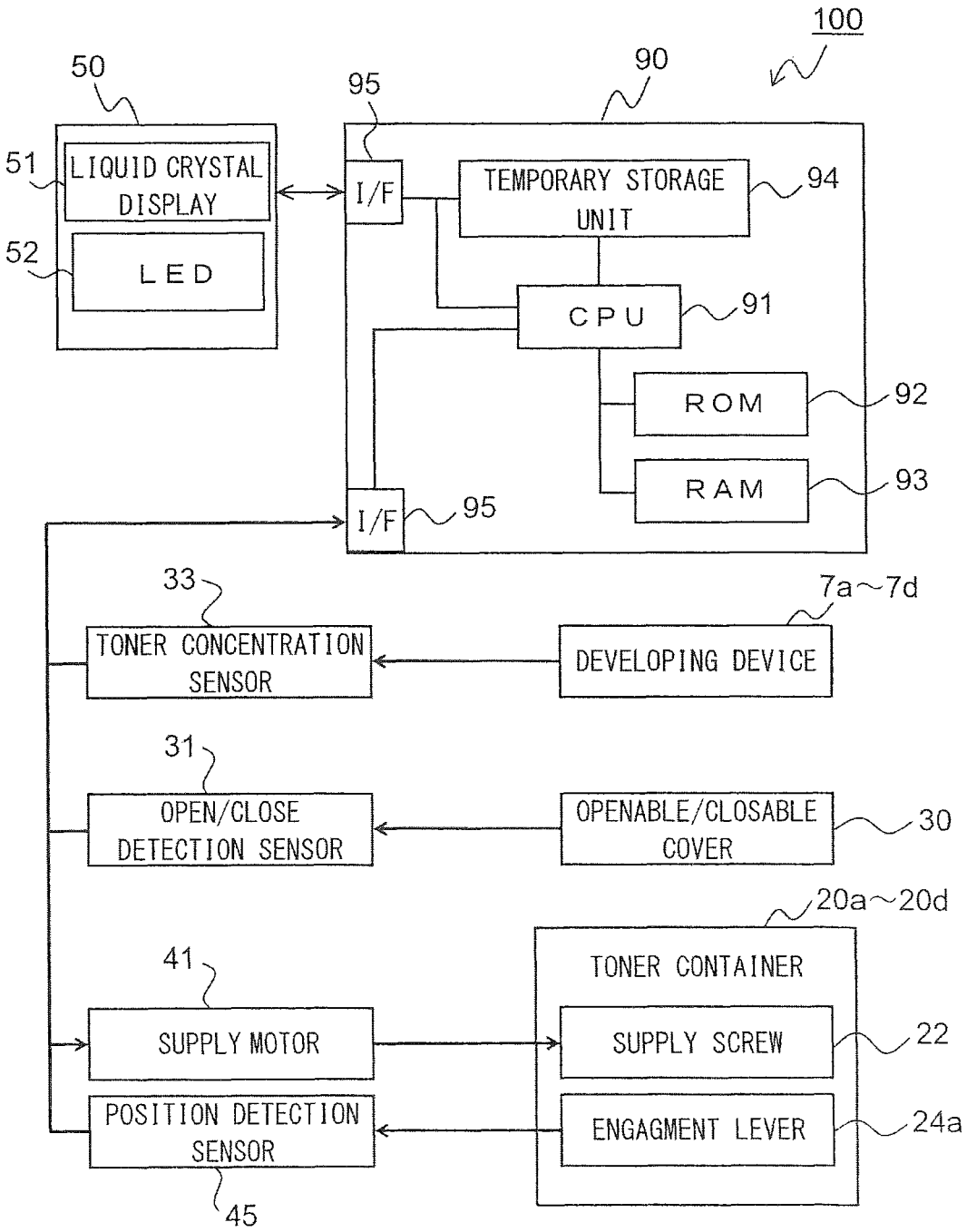
FIG. 7 is a block diagram for illustrating a control route of the image forming apparatus according to the embodiment of the present disclosure.

FIG. 7 is a block diagram for illustrating a control route of the image forming apparatus 100. In using the image forming apparatus 100, various forms of control are performed with respect to the various units of the apparatus, which renders a control route of the image forming apparatus 100 as a whole complicated. Accordingly, the description is focused herein on parts of the control route required for implementing the present disclosure, such as the detection of amounts of toner in the toner containers 20*a* to 20*d* and the locking and unlocking of the toner containers 20*a* to 20*d*.

The control unit 90 includes at least a CPU (Central Processing Unit) 91 as a central computation device, a ROM (Read Only Memory) 92 which is a read-only storage unit, a RAM (Random Access Memory) 93 which is a readable and rewritable storage unit, a temporary storage unit 94 which temporarily stores image data and the like, and a plurality of (here, two) I/Fs 95 which transmit control signals to various devices in the image forming apparatus 100 and receive an input signal from the operation panel 50.

In the ROM 92, programs for controlling the image forming apparatus 100, numerical values required for the control, data not to be changed during use of the image forming apparatus 100, and so on are contained. In the RAM 93, necessary data generated in a course of control of the image forming apparatus 100, data temporarily required for controlling the image forming apparatus 100, and so on are stored. In the ROM 92, a message storage table for storing a plurality of messages corresponding to various statuses of the toner containers 20*a* to 20*d* is provided.

The control unit 90 receives detection signals from a toner concentration sensor (toner sensor) 33, the open/close detection sensor 31, and the position detection sensor 45.

The toner concentration sensor 33 is provided one in each of the developing devices 7*a* to 7*d*, and used as the toner concentration sensor 33 is a magnetic permeability sensor for detecting magnetic permeability of a two-component developer including the toner and the magnetic carrier within in each of the developing devices 7*a* to 7*d*. Here, a toner concentration represents a ratio (T/C) of the toner to the magnetic carrier within the developer. In this embodiment, the toner concentration sensor 33 is configured to detect the magnetic permeability of the developer and output a voltage value corresponding to a result of the detection to the control unit 90. Then, the control unit 90 determines the toner concentration based on the output value from the toner concentration sensor 33.

The output value from the toner concentration sensor 33 varies with the toner concentration. As the toner concentration becomes higher, the ratio of the toner to the magnetic carrier becomes higher and the toner which does not transmit magnetism increases in proportion, and this causes the output value to become lower. On the other hand, as the toner concentration becomes lower, the ratio of the toner to the carrier becomes lower and the carrier which transmits magnetism increases in proportion, and this causes the output value to become higher.

A description will be given taking a combination of the developing device 7*a* and the toner container 20*a* as an example. The control unit 90 transmits a control signal to the supply motor 41 in accordance with a determined toner concentration, to make the supply screw 22 rotate forward, and thereby supplies toner to the developing device 7*a*. Furthermore, when the toner container 20*a* becomes empty, the control unit 90 makes the supply screw 22 rotate backward by making the corresponding supply motor 41 rotate backward, and thereby unlock the toner container 20*a*, which has become empty. Then, when the empty toner container 20*a* is replaced with a new toner container 20*a*, the control unit 90 makes the corresponding supply motor 41 rotate backward to make the supply screw 22 rotate backward, and thereby locks the new toner container 20*a*. This applies also to combinations of the other developing devices 7*b* to 7*d* with a corresponding one of the toner containers 20*b* to 20*d*.

The operation panel 50 includes a liquid crystal display 51, an LED 72 indicating various statuses, and a ten-key pad, and is configured to display a status of the image forming apparatus 100, a progress status of an image forming operation, the number of copies printed, and so on.

Next, descriptions will be given of an operation of supplying toner to the toner containers 20*a* to 20*d* and operations of locking and unlocking the toner containers 20*a* to 20*d*. Here, too, the descriptions will be given taking the combination of the developing device 7*a* and the toner container 20*a* as an example. The descriptions also apply to combinations of the other developing devices 7*b* to 7*d* with a corresponding one of the toner containers 20*b* to 20*d*.

Based on a detection result from the toner concentration sensor 33, the control unit 90 makes the supply motor 41 rotate forward to thereby make the supply screw 22 rotate forward to supply toner to the developing device 7*a*. At this time, as shown in FIG. 5, the toner container 20*a* is locked, and the engagement lever 24*a* is positioned in the engagement position, such that the optical path of the position detection sensor 45 is blocked by the engagement lever 24*a*.

In a case where, in spite of the toner having been supplied to the developing device 7*a* from the toner container 20*a*, the amount of toner (toner concentration) in the developing device 7*a* is equal to or less than a threshold value, the control unit 90 judges that there is no toner left (that the amount of toner has fallen to be equal to or less than a predetermined amount) in the toner container 20*a*. Then, the control unit 90 makes the corresponding supply motor 41 rotate backward to unlock only the toner container 20*a*.

Specifically, the backward rotation of the supply motor 41 causes the supply screw 22 to rotate backward, and the torque of the supply screw 22 is transmitted via the first gear 23 to the second gear 24, to cause the engagement lever 24*a* to rotate. When the engagement lever 24*a* rotates so as not to block the optical path of the position detection sensor 45 (or, when the engagement lever 24*a* is rotated a little further after the release of the blockage of the optical path), the control unit 90 stops the rotation of the supply motor 41 to make the engagement lever 24*a* stop in the disengagement position (the position in FIG. 6). Thereby, the locking of the toner container 20*a* is released.

Then, the control unit 90 displays a message urging replacement of the toner container 20*a* on the display 51 of the operation panel 50. Here, the timing of displaying the message urging replacement of the toner container 20*a* may be any time before the user starts replacing the toner container 20*a*, and the displaying may be performed in parallel with the unlocking of the toner container 20*a*.

Then, the user replaces the toner container 20*a* with a new one. In doing so, the user first opens the openable/closable cover 30, then removes the empty toner container 20*a*, attaches a new toner container 20*a*, and then closes the openable/closable cover 30. Here, the toner containers 20*b* to 20*d* are not empty yet, and thus are not unlocked, whereby the user is prevented from replacing the toner containers 20*b* to 20*d* by mistake when they are not empty yet.

On detecting, based on a detection result from the open/close detection sensor 31, that the openable/closable cover 30 has been opened/closed, the control unit 90 makes the corresponding supply motor 41 and the corresponding supply screw 22 rotate forward to supply toner to the developing device 7*a*. Then, on detecting, based on a detection result from the toner concentration sensor 33, that the amount of toner (toner concentration) in the developing device 7*a* has become greater than the threshold value, the control unit 90 judges that the toner container 20*a* has been appropriately replaced. Then, the control unit 90 makes the corresponding supply motor 41 rotate backward to lock the toner container 20*a*.

Specifically, the backward rotation of the supply motor 41 causes the supply screw 22 to rotate backward, and the torque of the supply screw 22 is transmitted via the first gear 23 to the second gear 24, to cause the engagement lever 24*a* to rotate. When the engagement lever 24*a* rotates so as to block the optical path of the position detection sensor 45 (or, when the engagement lever 24*a* is rotated a little further after the blockage), the control unit 90 stops the rotation of the supply motor 41 to make the engagement lever 24*a* stop in the engagement position (the position in FIG. 5). Thereby, the toner container 20*a* is locked.

On the other hand, in a case where, although the corresponding supply motor 41 and the corresponding supply screw 22 have been made to rotate forward after the detection of the opening/closing of the openable/closable cover 30, the amount of toner (toner concentration) in the developing device 7*a* remains equal to or less than the threshold value, the control unit 90 judges that the toner container 20*a* has not been replaced yet. In this case, the control unit 90 does not make the corresponding supply motor 41 rotate backward, but instead keeps the toner container 20*a* unlocked. Here, an example of the case where, although the corresponding supply motor 41 and the corresponding supply screw 22 have been made to rotate forward after the detection of the opening/closing of the openable/closable cover 30, the amount of toner (toner concentration) in the developing device 7*a* remains equal to or less than the threshold value is a case, for example, where a new toner container 20*a* is not available and thus the user has not been able to replace the toner container 20*a*.

In the present embodiment, as has been described above, in the case where the amount of toner in any of the toner containers 20*a* to 20*d* has become equal to or less than the predetermined amount, the control unit 90 makes the supply screw 22 rotate backward to release the engagement between the engagement lever 24*a* and the engagement member 44. Thereby, in the case where the amount of toner in any of the toner containers 20*a* to 20*d* is greater than the predetermined amount, the supply screw 22 is not made to rotate backward, and the engagement between the engagement lever 24*a* and the engagement member 44 is maintained. And, in the case where the amount of toner in any of the toner containers 20*a* to 20*d* has become equal to or less than the predetermined amount, the supply screw 22 is made to rotate backward, and the engagement between the engagement lever 24*a* and the engagement member 44 is released. Thus, since it is possible to switch between engagement and disengagement of the engagement lever 24*a* with respect to the engagement member 44 merely by making the supply screw 22 rotate backward, and this eliminates the need of additionally providing a solenoid or a motor as a drive source. This makes it possible to achieve lock and lock release of the toner containers 20*a* to 20*d* at low cost.

As has been described above, the position detection sensor 45 is provided which detects the position of the engagement lever 24*a*. This makes it easy to position the engagement lever 24*a* in the engagement position and the disengagement position.

As has been described above, the position detection sensor 45 is provided on the engagement member 44. This makes it easy to detect whether or not the engagement lever 24*a* is positioned in the engagement position.

As has been described above, the second gear train 25 is composed of the first gear 23, which is a one-way gear, and the second gear 24, which is provided with the engagement lever 24*a* and arranged on a side face of each of the toner containers 20*a* to 20*d*. This makes it easy to compose the second gear train 25.

As has been described above, the control unit 90 makes a judgment on whether or not amounts of toner in the toner containers 20*a* to 20*d* are equal to or less than the predetermined amount, based on detection results from the toner concentration sensors 33, which each detect the amount of toner in the corresponding one of the developing devices 7*a* to 7*d*. This eliminates the need of additionally providing toner sensors for detecting the amounts of toner in the toner containers 20*a* to 20*d*.

As has been described above, in the case where the plurality of (here, four) toner containers 20*a* to 20*d* are provided, the user may sometimes make a mistake of replacing any of the toner containers 20*a* to 20*d* that does not need to be replaced yet, and thus, it is particularly advantageous to provide a configuration where the toner containers 20*a* to 20*d* can be locked and unlocked so that none of the toner containers 20*a* to 20*d* cannot be replaced unless it is time for it to be replaced. Furthermore, it is particularly advantageous to reduce cost by applying, to the case where the plurality of toner containers 20*a* to 20*d* are provided, the present disclosure, which does not require the provision of an additional drive source for the locking and unlocking of the toner containers 20*a* to 20*d*.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above description has dealt with an example where the present disclosure is applied to a color multifunction peripheral, but the present disclosure is not limited to it. Needless to say, the present disclosure is applicable to various image forming apparatuses provided with a detachable/attachable toner storage container for storing toner to be supplied to a developing device, such as a monochrome multifunction peripheral, a color copier, a monochrome copier, a color printer, a monochrome printer, and a facsimile machine.

The above-described embodiment has dealt with an example where the position detection sensor 45 is provided for detecting the position of the engagement lever 24*a*, but the present disclosure is not limited to it. For example, the position of the engagement lever 24*a* may be detected based on the rotation time, the rotation rate (rotation angle), and the like of the supply motor 41.

The above-described embodiment has dealt with an example where the toner concentration sensor 33 is provided for detecting the amount of toner in each of the developing devices 7*a* to 7*d*, each storing a two-component developer, but in a case where a developing device storing a one-component developer is used, there may be provided a toner amount sensor (tone sensor) for detecting the amount toner in the developing device.

The above-described embodiment has dealt with an example where detection of whether or not the amount of toner in each of the toner containers 20*a* to 20*d* is equal to or less than a predetermined amount is performed by detecting the amount of toner in each of the developing devices 7*a* to 7*d*, but a toner sensor may be provided in each of the toner containers 20*a* to 20*d* for directly detecting the amount of toner in each of the toner containers 20*a* to 20*d*.

The above-described embodiment has dealt with an example where the second gear train 25 is composed of two gears (the first gear 23 and the second gear 24), but the present disclosure is not limited to it. The second gear train 25 may be a single gear (the first gear 23), and the first gear 23 may be provided with an engagement lever (first engagement unit). Or, the second gear train 25 may be composed of three or more gears.

The above-described embodiment has dealt with an example where the toner container 20*a* is locked when it is detected that the amount of toner in the developing device 7*a* has become greater than a threshold value after the opening/closing of the openable/closable cover 30 is detected and toner is supplied to the developing device 7*a*, but the present disclosure is not limited to it. For example, the toner container 20*a* may be locked when the opening/closing of the openable/closable cover 30 is detected.

What is claimed is:

1. An image forming apparatus comprising:

an apparatus main body;

a developing device provided in the apparatus main body;

a toner storage container for storing toner to be supplied to the developing device, the toner storage container being detachable and attachable with respect to the apparatus main body;

a toner sensor for detecting that an amount of toner in the toner storage container has become equal to or less than a predetermined amount; and a control unit that restrains or allows detachment/attachment of the toner storage container in accordance with a detection result from the toner sensor, wherein the toner storage container includes a supply screw which conveys and supplies the toner to the developing device by rotating forward, and a first engagement unit which is coupled via a gear train to a rotation shaft of the supply screw, the apparatus main body includes a second engagement unit which engages with the first engagement unit to restrain detachment/attachment of the toner storage container, the gear train includes a one-way gear which transmits torque to the first engagement unit only when the supply screw rotates backward, and in a case where the amount of toner in the toner storage container has become equal to or less than the predetermined amount, the control unit makes the supply screw rotate backward to thereby release engagement between the first engagement unit and the second engagement unit.

2. The image forming apparatus according to claim 1, wherein the first engagement unit is selectively positioned in an engagement position where the first engagement unit is engaged with the second engagement unit or in a disengagement position where the first engagement unit is not engaged with the second engagement unit, and a position detection sensor is further provided which detects whether the first engagement unit is positioned in the engagement position or in the disengagement position.

3. The image forming apparatus according to claim 2, wherein the position detection sensor is provided on the second engagement unit.

4. The image forming apparatus according to claim 1, wherein the gear train includes a first gear which is the one-way gear coupled to the supply screw and a second gear provided with the first engagement unit and disposed on a side face of the toner storage container.

5. The image forming apparatus according to claim 1, wherein the toner sensor detects the amount of toner in the developing device, and the control unit judges whether or not the amount of toner in the toner storage container is equal to or less than the predetermined amount based on the detection result from the toner sensor.

6. The image forming apparatus according to claim 1, wherein the developing device is one of a plurality of developing devices and the toner storage container is one of a plurality of toner storage containers.

* * * * *